United States Patent [19]

Chen et al.

[11] Patent Number: 4,746,453

[45] Date of Patent: May 24, 1988

[54] CLEANING COMPOSITION FOR ELECTROCLEANING COLD-ROLLED STEEL

[75] Inventors: Pao-Yuan Chen; Sen-Thann Shen; Ping-Cherng Sun, all of Kaohsiung, Taiwan

[73] Assignee: China Steel Corporation, Kaohsiung, Taiwan

[21] Appl. No.: 928,875

[22] Filed: Nov. 7, 1986

[51] Int. Cl.[4] ..... C11D 7/14

[52] U.S. Cl. ..... 252/135; 252/156; 252/174.21; 252/174.22; 252/525; 252/527; 252/321; 252/358

[58] Field of Search ..... 252/135, 525, 527, 156, 252/174.21, 174.22

[56] References Cited

U.S. PATENT DOCUMENTS

| | | | |
|---|---|---|---|
| 3,282,843 | 11/1966 | Alburger | 252/52 |
| 4,048,121 | 9/1977 | Chang | 252/527 |
| 4,093,566 | 6/1978 | MacNamara | 252/156 |
| 4,349,448 | 9/1982 | Steele | 252/135 |
| 4,382,825 | 5/1983 | McCready | 252/156 |
| 4,390,465 | 6/1983 | Spekman | 252/527 |
| 4,597,888 | 7/1986 | King | 252/156 |

FOREIGN PATENT DOCUMENTS

| | | | |
|---|---|---|---|
| 0762816 | 8/1971 | Belgium | 252/156 |
| 1308433 | 2/1973 | United Kingdom | 252/174.22 |
| 1445716 | 8/1976 | United Kingdom | 252/174.22 |

*Primary Examiner*—Paul Lieberman
*Assistant Examiner*—Isabelle Rodriguez
*Attorney, Agent, or Firm*—Arnold, White & Durkee

[57] ABSTRACT

A cleaning composition for electrolytically cleaning cold-rolled steelwork includes sodium or potassium hydroxide, sodium or potassium orthosilicate and a combination of non-ionic surface-active agents; said non-ionic surface active agent includes a major amount of lauryl polyethylene glycol ether with 10 moles of average ethylene oxide, and a minor amount of nonyl phenyl polyethylene glycol ether with 1 mole of average ethylene oxide. By virtue of adding two non-ionic surface active agents in such an amount ratio, an excellent defoaming and cleaning effect can be obtained. Inclusion of hexamethylenetetramine in the cleaning composition can inhibit the deposition of ferric oxide and silicone oxide during electrocleaning which normally gives rise to the problem of light fault.

9 Claims, No Drawings

CLEANING COMPOSITION FOR ELECTROCLEANING COLD-ROLLED STEEL

BACKGROUND OF THE INVENTION

The present invention relates to a cleaning composition for electrocleaning, and particularly to a cleaning composition for electrolytically cleaning cold-rolled steel with high current density.

If it is intended that a thinner steel coil be manufactured, the steel work can be subjected to the treatment of cold-rolling. In doing this, a roll coolant must be added for dissipating the heat generated by mechanical rolling on the surface of the steel work. Therefore, subsequent to the cold rolling operation, roll coolant which primarily includes animal oil or mineral oil together with other soils, such as iron smut, will be left on the surface of the cold-rolled steel. Before the cold-rolled steel work is subjected to annealing treatment, such soils should be thoroughly removed from the surface. Otherwise the residual oil smudge will be cracked into carbon residue or a lower carbon compound which is deleterious to the quality of the surface of the resultant steel plate, and this problem manifests itself in a poor finishing job, e.g. poor adherence in electroplating.

Due to its property of saponifying fats and oils to make water-soluble soaps, its capabilities of attacking organics and splitting esters, sodium or potassium hydroxide has been used as the most important alkali for metal cleaning. Particularly, its highest conductivity renders it an indispensible component in electrolytic cleaning composition.

It has been also described that when compounded with surfactants, silicates are the best emulsifying and deflocculating agents of all the alkali. Also their excellent buffer function in high basicity make them necessary for long-life electrocleaning compositions. On the other hand, silicates can be a possible source of trouble in subsequent plating operations and thus are suggested not to be included in the cleaning compositions for some metal cleaning processes. Sodium orthosilicate has been reported as one silicate which is widely used in steel cleaners.

Chelating agents have acquired an important role in conventional cleaning formulations in the case that little or no phosphate should be included. The most widely used chelating agents in metal cleaners are sodium gluconate, trisodium nitrilotriacetate and EDTA. These compounds can soften water and tie up many metal ions so as to enhance the cleaning effect of the cleaners.

Evidently, decreasing surface and interfacial tension will help in washing out the oil from the surface. However, specific selection of surfactants is important in electrolytic cleaning. Though nonionic surfactants have been used in combination with anionics in soak and spray cleaners, they have not been positively disclosed or suggested to be used in electrocleaners. Only the anionic type of surfactants has been disclosed for the purpose of electrocleaning. Finally, it is particularly desired in high-current-density electrocleaning to select a combination of surfactants which have good defoaming properties, because in electrocleaning with high current density, an enormous amount of hydrogen and oxygen evolves giving rise to voluminous foams which adversely cause current loss and affect the efficiency of the electrolysis.

It is known that hexamethylenetetramine can be used as a pickling inhibitor in hydrochloric and sulfuric acid. However, to the knowledge of the inventors, no literature has disclosed hexamethylenetetramine used in a formulation for electrolytic cleaning.

In view of the fact that conditions needed for conducting a electrolytic cleaning of a rolled metal sheet with high current density are very unique, to figure out a suitable cleaning formulation which can perform optimal cleaning function involves an enormous amount of experiments in light of the general teachings as discussed above.

SUMMARY OF THE INVENTION

It is an object of this invention to provide a cleaning composition which can perform optimal electrocleaning action on a cold-rolled steel sheet.

It is another object of this invention to provide a cleaning composition for electrolytic cleaning with high density current without much consumption of defoaming agent.

It is a further object of this invention to provide an electrocleaning composition which will alleviate the problem of the tendency to adhere of two opposed surfaces on two adjacent segments of a coil of steel sheet.

It is still another object of this invention to provide an electrocleaning composition which can inhibit the occurrence of overvoltage as to reduce the consumption of electricity.

In accordance with the present invention, a cleaning composition for electrolytically cleaning cold-rolled steelwork comprises sodium or potassium hydroxide, a silicate and a non-ionic surface-active agent, in which said non-ionic surface active agent includes a major amount of lauryl polyethylene glycol ether with 10 moles of average ethylene oxide, and a minor amount of nonyl phenyl polyethylene glycol ether with 1 mole of average ethylene oxide. By virtue of adding two non-ionic surface active agents in such an amount ratio, excellent defoaming property can be obtained and the need of defoaming agent is greatly decreased. Preferably said silicate is sodium orthosilicate. Most preferably, said cleaning composition contains from about 20 to about 60 percent by weight of sodium hydroxide, from about 20 to about 60 percent by weight of sodium orthosilicate and from about 0.1 to about 20 percent by weight of nonionic surface active agent. The inclusion of sodium orthosilicate in the cleaning composition can not only increase the usable life of the cleaning solution, but also causes the formation of a thin layer of silicon dioxide which can effectively protect the surface of the cleaned steel sheet from scratching and sticking during the annealing procedure. (Such problems are encountered quite often with the use of the conventional electrocleaning composition.)

In accordance with another aspect of this invention, from about 1 to about 20 percent by weight of hexamethylenetetramine is added so as to inhibit the phenomenon of overvoltage which develops during the procedure of electrolytic cleaning.

In accordance with a further aspect of this invention, from about 1 to about 20 percent by weight of a chelating agent can be added. Said chelating agent is selected from a group consisting of sodium gluconate, trisodium nitrilotriacetate and the mixtures thereof. Due to the incorporation of the chelating agent, calcium and magnesium as well as other heavy metal ion will be sequestered and prohibited from contacting sodium orthosilicate and the stearates resulted from saponification. Therefore the formation of insoluble scum which affects the conductivity of the electrocleaning solution and contaminates the surface of the steel sheet will substantially be eliminated.

The following exemplary embodiments are provided for illustration of the present invention and should not be construed as limiting the scope of this invention.

DETAILED DESCRIPTION OF THE PREFERRED EMBODIMENTS 150 kg sodium hydroxide, 200 kg sodium orthosilicate, 100 kg sodium gluconate, 100 kg trisodium nitrilotriacetate, 100 kg Lauryl polyethylene glycol ether having a formula of $C_{12}H_{25}$—O—$(CH_2CH_2O)_{10}$—H and 10 kg nonyl phenyl polyethylene glycol ether having a formula of $C_9H_{19}$—$C_6H_4$—O—$(CH_2CH_2O)$—H and 10 kg hexamine are mixed to form a basic cleaning composition and pumped into a circulation tank. About 21,663 kg water is added to the basic cleaning composition to make up 3% by weight of the basic electrocleaning solution. The basic electrocleaning solution is used to wash the conveyed cold-rolled steel at the stage of brush scrubbing and then is sprayed into a high-current-density electrolytic cleaning tank for the processing of electrocleaning. In the electrocleaning the cold-rolled steel to be washed is made the cathode, while the inert anode is made of steel. Due to the evolution of copious gas at the surface of the cold-rolled steel, the mechanical action of the gas helps in dislodging the soil and simultaneously bring up fresh solution to the surface. No deposition on the steel anode appears even after a period of time; it is believed that this effect is due to the inclusion of hexamine. As a consequence, no light fault caused by overvoltage occurs when utilizing the electrocleaning solution according to this invention as opposed to a electrocleaning solution without hexamine. The advantage of the addition of hexamine in the electrocleaning solution will be illustrated hereafter. It is to be noted that adding lauryl polyethylene glycol ether having a formula of $C_{12}H_{25}$—O—$(CH_2CH_2O)_{10}$—H and nonyl phenyl polyethylene glycol ether having a formula of $C_9H_{19}$—$C_6H_4$—O—$(CH_2CH_2O)$—H as surface-active agents in such a proportion attains an excellent defoaming effect which desirably decreases the consumption of defoaming agents. The effectiveness of the combination of these two surface-active agents will be illustrated hereafter.

The used electrocleaning solution is collected and flow back to the recirculation tank. The consumed amount of electrocleaning solution should be frequently supplemented before it is recirculated for the next use. Subsequently, the cold-rolled steel plate is subject to be rinsed twice with hot water in the hot rinse tank and then dried. The cleanliness of the surface of the resultant steel plate is assessed by the water break test as very satisfactory.

In practice, it has been found that only 0.367 kg of the basic electrocleaning composition accompanied by 0.018 kg defoaming agent is needed for producing 1 ton of steel plate. At the same time, light fault on the anode develops rather slowly, so the average operation time can last for 172 hours. In view of the slow development of anodic overvoltage, consumption of electricity can be desirably reduced. Furthermore, the sufficient amount of silicon dioxide left on the surface can efficiently alleviate the sticking problem of the surface of the steelwork.

To show the excellent defoaming effect provided by a combination of a minor amount of nonyl phenyl polyethylene glycol ether with 1 mole of average ethylene oxide and a major amount of lauryl polyethylene glycol ether with 10 moles of average ethylene oxide, two electrocleaning solutions, i.e. CTY410 and CTY412 are prepared for testing the defoaming effect. CTY412 is prepared by repeating the same procedure as for the preparation of the above-mentioned basic electrocleaning solution except that no hexamine is included and balanced water is added to make up 3% by weight of electrocleaning solution. CTY410 is prepared by repeating the same procedure for the preparation of CTY412 except that nonyl phenyl polyethylene glycol ether with 1 mole of average ethylene oxide is not included and the balanced water is added to make up 3% by weight of electrocleaning solution. In other words, adding about 0.01% by weight of nonyl phenol polyethylene glycol ether with 1 mole of average ethylene oxide to CTY410 will form electrocleaning solution CTY412. The test of the defoaming effect is conducted for CTY412 and CTY410 according to ASTM D1173 method. The height of foam in the respective solution varying with time is listed in Table I.

TABLE I

| time (min) | CTY410 height of foam (cm) | CTY412 height of foam (cm) | CTY410* height of foam (cm) | CTY412* height of foam (cm) |
|---|---|---|---|---|
| 0 | 3.5 | 1.2 | 12.0 | 3.5 |
| 0.5 | 2.0 | 1.0 | 9.0 | 1.5 |
| 1.0 | 1.5 | 0.8 | 2.0 | 1.2 |
| 1.5 | 1.2 | 0.7 | 1.0 | 1.0 |
| 2.0 | 1.0 | 0.7 | 0.8 | 0.8 |
| 3.0 | 0.7 | 0.3 | 0.7 | 0.7 |
| 4.0 | 0.5 | 0.1 | 0.5 | 0.5 |
| 5.0 | 0.5 | 0.1 | 0.5 | 0.3 |

*To the electrocleaning solutions CTY410 and CTY412 are respectively added 0.5% by volume of rolling oil which comprises about 45% by weight of animal oil, such as tallow oil or lard oil, and 45% by weight of mineral oil as well as a slight amount of emulsifying agents and other additives. The rolling oil is left on the surface of cold-rolled steel after the cold-rolling treatment.

It can be noted from the lower height of the foam in testing CTY412 that inclusion of a slight amount of nonyl phenol polyethylene glycol with 1 mole of average ethylene oxide mole number greatly enhances the defoaming effect. To demonstrate the excellent capability of hexamine of inhibiting overvoltage on the inert steel electrode, nine sample solutions as listed in Table II are prepared. For simulating used electrocleaning solution which has been used for three days in electrocleaning the cold-rolled sheet as mentioned above, 70 ppm concentration of ferric ion is added to CTY412 to act as a control solution. The test results are tabulated in Table II.

TABLE II

| Sample No. | Added Fe conc. (ppm) | Electrolysis time | Voltage change (volt) | deposition on anode surface |
|---|---|---|---|---|
| control | 70 | 2 min | 12→20 | $Fe_2O_3 + SiO_2$ |
| 1 | 70 | 2 hrs | 12→12 | No |
| 2 | 70 | 2 hrs | 12→12 | No |
| 3 | 70 | <5 min | 12→20 | $Fe_2O_3 + SiO_2$ |
| 4 | 70 | <5 min | 12→20 | $Fe_2O_3 + SiO_2$ |
| 5 | 70 | <5 min | 12→20 | $Fe_2O_3 + SiO_2$ |
| 6 | 70 | <5 min | 12→20 | $Fe_2O_3 + SiO_2$ |
| 7 | 70 | <5 min | 12→20 | $Fe_2O_3 + SiO_2$ |
| 8 | 70 | <5 min | 12→20 | $Fe_2O_3 + SiO_2$ |

TABLE II-continued

| Sample No. | Added Fe conc. (ppm) | Electrolysis time | Voltage change (volt) | deposition on anode surface |
|---|---|---|---|---|
| 9 | 70 | <5 min | 12→20 | $Fe_2O_3 + SiO_2$ |

NOTE:
1. Sample 1 is prepared by adding 0.1% by weight of hexamine to CTY412.
2. Sample 2 is prepared by adding 0.2% by weight of hexamine to CTY412
3. Sample 3 is prepared by adding 0.2% by weight of triethylamine to CTY412.
4. Sample 4 is prepared by adding 0.2% by weight of diphenylamine to CTY412.
5. Sample 5 is prepared by adding 0.2% by weight of cyclohexylamine to CTY412.
6. Sample 6 is prepared by adding 0.2% by weight of n-propylamine to CTY412.
7. Sample 7 is prepared by adding 0.2% by weight of 2-butyn-1,4-diol to CTY412.
8. Sample 8 is prepared by adding 0.2% by weight of 2-mercaptobenzothiazole.
9. Sample 9 is prepared by adding 0.2% by weight of 1,2,3-benzothiazole.

It can be seen that inclusion of hexamethylenetetramine can inhibit to a surprising extent the deposition of ferric oxide and silicone oxide on the surface of the anode, which is believed to cause overvoltage during electrocleaning. Though some other pickling inhibitors, such as 2-butyn-1,4-diol and cyclohexylamine as shown in Table II have been utilized for this purpose, no desirable effect can be obtained, as with hexamethylenetetramine. The mechanism of inhibition of deposition by using hexamethylenetetramine is not very clear to us. It is believed that probably its high molecular weight and electron donor capability to the steel surface accounts for its excellent inhibition of deposition. In addition, hexamethylenetetramine is not easily oxidized.

We claim:

1. A cleaning composition for electrolytically cleaning cold-rolled steelwork comprising from about 20 to about 60 percent by weight of alkali metal hydroxide, from about 20 to about 60 percent by weight of a silicate, and from about 0.1 percent to about 20 percent by weight of a non-ionic surface-active agent, in which said non-ionic surface active agent includes a major amount of lauryl polyethylene glycol ether with average 10 ethylene oxide units, and a minor amount of nonyl phenyl ethylene glycol ether.

2. A cleaning composition for electrolytically cleaning cold-rolled steelwork as claimed in claim 1, wherein said silicate is selected from a group consisting of potassium orthosilicate and sodium orthosilicate, and said alkali metal hydroxide is selected from a group consisting of potassium hydroxide and sodium hydroxide.

3. A cleaning composition for electrolytically cleaning cold-rolled steelwork as claimed in claim 2, wherein the weight ratio of lauryl polyethylene glycol ether with average 10 ethylene oxide units to nonyl phenyl ethylene glycol ether is 9–10:1.

4. A cleaning composition for electrolytically cleaning cold-rolled steelwork comprising from about 20 to about 60 percent by weight of alkali metal hydroxide, from about 20 to about 60 percent by weight of a silicate, and from about 0.1 percent to about 20 percent by weight of a non-ionic surface active agent, in which said non-ionic surface active agent includes a major amount of lauryl polyethylene glycol ether with average 10 ethylene oxide units, and a minor amount of nonyl phenyl ethylene glycol ether, said composition further comprising hexamethylenetetramine.

5. A cleaning composition as claimed in claim 4, further comprising from about 1 to about 20 percent by weight of hexamethylenetetramine.

6. A cleaning composition as claimed in claim 5, further comprising from about 1 to about 20 percent by weight of a chelating agent.

7. A cleaning composition as claimed in claim 6, wherein said chelating agent is selected from a group consisting of sodium gluconate, trisodium nitrilotriacetate and the mixture thereof.

8. A cleaning composition as claimed in claim 4, wherein said silicate is selected from a group consisting of potassium orthosilicate and sodium orthosilicate, and said alkali metal hydroxide is selected from a group consisting of potassium hydroxide and sodium hydroxide.

9. A cleaning composition as claimed in claim 8, wherein the weight ratio of lauryl polyethylene glycol ether with average 10 ethylene oxide units to nonyl phenyl ethylene glycol ether is 9–10:1.

* * * * *